US008286372B2

(12) United States Patent
Shirokikh

(10) Patent No.: US 8,286,372 B2
(45) Date of Patent: Oct. 16, 2012

(54) FOOTWEAR WITH ENERGY ACCUMULATION

(76) Inventor: Mark Rudolfovich Shirokikh, Chelyabinsk (RU)

( * ) Notice: Subject to any disclaimer, the term of this patent is extended or adjusted under 35 U.S.C. 154(b) by 446 days.

(21) Appl. No.: 12/378,677

(22) Filed: Feb. 18, 2009

(65) Prior Publication Data

US 2009/0217551 A1 Sep. 3, 2009

(30) Foreign Application Priority Data

Feb. 29, 2008 (RU) ..... 2008107517
Jun. 9, 2008 (RU) ..... 2008122927

(51) Int. Cl.
*A43B 5/12* (2006.01)
*A43B 3/00* (2006.01)

(52) U.S. Cl. ..... 36/102; 36/27; 36/7.8

(58) Field of Classification Search ..... 36/102, 36/27, 114, 7.8, 28
See application file for complete search history.

(56) References Cited

U.S. PATENT DOCUMENTS 871,864 A * 11/1907 Feazell et al. ..... 36/7.8
898,084 A * 9/1908 Backermann ..... 36/7.8
2,172,000 A * 9/1939 Wenker ..... 482/77
2,582,910 A * 1/1952 Lyon ..... 36/109
4,294,238 A * 10/1981 Woodford ..... 602/23
4,360,978 A * 11/1982 Simpkins ..... 36/114
5,090,138 A * 2/1992 Borden ..... 36/102
5,269,748 A * 12/1993 Lonardo ..... 602/27
5,343,636 A * 9/1994 Sabol ..... 36/7.8
5,343,637 A 9/1994 Schindler
5,469,638 A 11/1995 Crawford
5,475,935 A * 12/1995 Frost ..... 36/89
5,517,769 A * 5/1996 Zhao ..... 36/27
5,621,985 A * 4/1997 Frost ..... 36/89
5,649,373 A 7/1997 Winter
6,397,496 B1 * 6/2002 Seymour ..... 36/27
6,840,893 B2 1/2005 Yoon
7,100,308 B2 * 9/2006 Aveni ..... 36/27
7,900,376 B2 * 3/2011 Rabushka ..... 36/27

(Continued)

FOREIGN PATENT DOCUMENTS

DE 4038511 6/1992

(Continued)

OTHER PUBLICATIONS

English Abstract of DE4038511.

*Primary Examiner* — Marie Patterson
(74) *Attorney, Agent, or Firm* — Preston Smirman; Smirman IP Law, PLLC

(57) ABSTRACT

Footwear with energy accumulation is presented. In a first version, the footwear comprises a sole, back, associated therewith, and fixation means coupled with the sole and back for securing a user's foot on the sole. The sole and back are disposed at an initial angle exceeding 90° therebetween, and form a leaf spring, while being arms of the spring. Alternatively, the leaf spring is made separate from the sole and back, having two arms respectively coupled with them. In a second version, the footwear comprises a sole including a frontal portion and a rear portion, the frontal portion is formed as a console spring downwardly bent out and cantileveredly secured to the rear portion, and fixation means for securing the user's foot on the sole, coupled therewith and depressing the front part of the foot against the spring. The portions are disposed at an initial angle therebetween less than 180°.

10 Claims, 9 Drawing Sheets

U.S. PATENT DOCUMENTS

| | | | | |
|---|---|---|---|---|
| 2003/0145495 | A1* | 8/2003 | Green | 36/145 |
| 2005/0138848 | A1* | 6/2005 | Fullerton | 36/113 |
| 2009/0151200 | A1* | 6/2009 | Niedermeyer et al. | 36/88 |

FOREIGN PATENT DOCUMENTS

| | | |
|---|---|---|
| EP | 552994 | 7/1993 |
| FR | 2575368 | 7/1986 |
| GB | 191029781 | 0/1911 |
| GB | 608180 | 9/1948 |
| GB | 2037569 | 7/1980 |
| GB | 2428366 | 1/2007 |
| RU | 2009651 | 3/1994 |
| RU | 2242153 | 7/2003 |
| RU | 2238125 | 10/2004 |
| RU | 2240168 | 11/2004 |
| SU | 963447 | 9/1982 |
| SU | 1253591 | 8/1986 |
| SU | 1387967 | 4/1988 |
| WO | WO9835726 | 2/1998 |
| WO | WO00-59323 | 10/2000 |
| WO | WO03018141 | 8/2002 |

* cited by examiner

FOOTWEAR WITH ENERGY ACCUMULATION

CROSS-REFERENCE TO RELATED APPLICATION

This U.S. patent application claims priority under 35 U.S.C. 119 (a) through (d) of Russian Federation patent applications RU2008107517 filed on 29 Feb. 2008, and RU2008122927 filed on 9 Jun. 2008 hereby entirely incorporated by reference.

BACKGROUND OF THE INVENTION

The invention relates to the field of footwear for daily use, sports footwear, including footwear for running, jumping, skating, skiing, bicycling etc., and footwear used as a means of rehabilitation for restoration of workability of leg muscles.

Usually footwear serves for protection of human legs against external influences. According to its intended purpose, footwear typically comprises a solid and strong enough sole and an upper part (an 'upper') connected to the sole, and ensuring retention of the footwear on the feet, and protecting them, if necessary from environmental influences. The rear end of the upper in the majority of footwear types is supplied with rigid inserts forming a back. The forms of execution of the sole and the upper depend on the purpose of footwear, and can vary (e.g. see Bolshaya Sovetskaya Entsiklopediya—The Great Soviet Encyclopedia, herein further referred to as BSE. Obuv.Http://slovari.yandex.ru/dict/bse/article/0005 4).

The specified footwear does not influence appreciably the way of a person's movement. During the walking a person raises one leg, leaning that moment on the second one, transfers the raised leg forward and lowers it on the bearing surface (ground). Then the process is repeated (BSE. http://slovari.yandex.ru/dict/bse/article/00086/96200.htm?text=%D1%85%D0%BE%D0% B4% D1%8C% D0%B1% D0%B0).

One of the features of a person's way of moving in comparison with the majority of other mammalians is the character of contact of a leg with the bearing surface. A person transferring his/her weight on the other leg leans at the first on the foot's heel bone and then transfers the load (person's weight) on the foot as a whole.

The defect of such a way of moving in walking is an irrational energy expenditure. The gravitational component at each step is completely lost. The body organs that are able to partially store the energy, for example the Achilles tendon and ankle joint, are working not effectively enough.

The majority of animals moves in another way. The primary contact with the bearing surface (ground) is carried out by them by the front (forward) part of the leg (paw), which means that the ankle joints of the feet work for twisting, the sinews are stretched accumulating energy, and then an energy release and additional repulsing of the leg (paw) occur, carrying out the following step or jump.

With a person, the primary support on the toes and the leg's instep bone occurs only occasionally, for example at running.

There are well known a plenty of various devices designed to increase a person's moving efficiency based on energy accumulation by ad elastic element capable of deformation at walking and energy release at return of this element to an initial position.

Footwear used mainly for sports is known, including a support device executed as a boot enveloping a shank with an auxiliary system in the form of a spring-loaded device with levers springed up by helix spiral springs, wherein the major lever is positioned close to the boot's sole with a possibility of turning and longitudinal displacement with regard to that axis, and whereat a base part of the major lever projects down relatively to the boot sole (see patent of the Russian Federation RU2238125, priority 27 Apr. 1998 GB).

During the walking, a user raises a leg and the boot thereon so that the boot and the protruding lever do not touch the ground. Then, in movement of the boot downwards, the major lever, first touching the ground, turns, overcoming the reaction of the spring, causing deformation of the spiral spring with accumulation of energy, which will help in the further upward movement of the boot.

A shortcoming of the above-described footwear and the way of movement while wearing it is a significant complexity of its design and inconvenience of the movement, in particular related to the necessity of raising the footwear to a considerable height.

A similar principle is used in designing a device according to U.S. Pat. No. 6,840,893, filed 29 Apr. 2002. The aforementioned device is also based on the use of springs deformed during the lowering of a leg onto the ground and the returning of energy when the leg is further raised. However such design is also bulky and unacceptable for use in the daily life.

There is known footwear designed as a high boot supplied with a device for increasing a jumping ability, comprising a support element ensuring a reliable fixation of the foot and another element, embracing the calf and connected with the first element, providing for a turn, wherein a pivotal unit is disposed along the same axis with the ankle joint. Both elements are connected to each other by an expansion spring (Patent of Germany DE 4038511, priority 3 Dec. 1990). The deficiencies of a device designed in such a way are similar to the ones of the above mentioned prior art devices: the complexity of design, inconvenience of operation, impracticability of use in the daily life. The way of moving while wearing such footwear requires significant efforts, special skills and advanced coordination abilities.

In the instant inventor's opinion, a related art footwear most close to the present invention is taught in U.S. Pat. No. 6,840,893 filed 17 Jul. 2003. The related art footwear (further called 'prototype') includes a device for increasing the jumping ability of the wearer. The prototype includes a support platform capable of fixation of the foot position. The rear part of the platform is connected by means of a vertical element to an element of fixation of the footwear on the calf. The lower part of platform is hingedly coupled by means of a lever with the lower part of an arc-shaped plate spring supplied with an overlay with a radial and wear-proof surface. The upper part of platform is rigidly coupled with the element of fixation of the footwear on the calf.

A person's walking in the aforesaid footwear is carried out by means of a sequential raising and lowering of the feet. With lowering a foot, the arched spring is bent, and its bottom end comes nearer to the platform. At raising the foot, the spring is freed and pushes the foot fixed within the device forward and upward.

The spurt in jumping or at the moment of a takeoff when running in the footwear with energy accumulation is actualized by means of compulsory deformation (loading) of the spring and subsequent repulsing the foot from the ground with the use of energy freed due to the release of the spring.

The ankle joint and the Achilles tendon operation do not influence the jumping efficiency. The deformation of the spring is effected only at the expense of a person's weight. The use of an arched spring has allowed avoiding spiral springs that has increased the efficiency of energy accumulation and reliability of the device's operation.

However the character of landing the foot with the device has not just changed but has also become more expressed: a primary support on the back part of the foot, and quick transfer of the body mass on the whole feet.

The use of footwear with such a device will entail the following drawbacks:

- Substantial complexity of design of the footwear equipped with the specified mechanism;
- Impossibility to increase the efficiency of the usual walking process, complexity of the use of the footwear in the daily life;
- The process of walking requires raising the legs to a significant height;
- The process of walking requires significant efforts, special skills and good movement coordination of the user.
- In addition, such footwear cannot be used for other kinds of movement, for example, for skating, skiing etc.

BRIEF DESCRIPTION OF THE INVENTION

The primary object of the present invention is the creation of simple and user-friendly footwear widely usable in the daily life, sports, medicine etc., allowing to effectively deploy not only the user's weight, but also his/her muscle energy for energy accumulation caused by elastic deformation, and for transfer of the energy for the next push of the foot against the support surface, increasing the efficiency of walking. Other objects can be appreciated by those skilled in the art upon learning the present disclosure.

The aforesaid object is achieved by designing the inventive footwear with energy accumulation disclosed herein below.

In a first version, the footwear comprises an elastic sole; an elastic back element, associated with the sole; and fixation elements coupled with the sole and with the back element; the fixation elements secure the position of the foot on the sole; wherein, according to the invention, the sole and the back element are disposed at an initial angle exceeding 90° therebetween, and form a knee-shaped flat elastically deformable spring (herein also called a 'leaf spring') with a predetermined elasticity, while the sole and the back element are being 'arms' (or shoulders) of the leaf spring.

The leaf spring can be executed as a whole with the sole and the back element rigidly coupled to each other, in which case the sole and the back element are the arms of the leaf spring. Alternatively, the spring's arms can be produced separate and then attached respectively to a common sole and a common back element.

The sole and the back element forming the leaf spring can be produced of an elastic polymeric material.

The initial angle between the spring's arms may vary depending on required properties as well as on the purpose of the footwear and physical abilities of the user.

The cross-section of the spring may be performed constant or variable along its length.

The spring's elastic properties and rigidity may be arranged constant or variable along its length and/or width.

The leaf spring may include sections with a C-shape cross-section for a partial envelopment of the foot.

In a second version, the footwear comprises: a sole including a frontal portion and a rear portion, which sole is coupled with fixation elements, securing the position of the foot on the sole, wherein, according to the invention, the frontal portion of the sole is formed as a console spring downwardly bent out and cantileveredly secured to the rear (remaining) portion of the sole, while the fixation elements depress the front part of the foot against the spring.

The spring can be executed as a whole with the frontal element of the sole. Alternatively, it can be rigidly connected with the sole's frontal portion.

An initial angle between the bent down spring and the rear portion of the sole on the underside thereof is less than 1800.

The following features can preferably be arranged for the second version footwear:

- The zone of fastening and bending of the spring can be located in the following regions of the foot: at the beginning of metatarsus, at the toe bones of the foot, or closer to the heel.
- The spring can be produced of an elastic polymeric material or another elastic material.
- The initial bending angle of the sole's spring can be chosen depending on its properties as well as the purpose of the footwear and physical abilities of the user.
- The cross-section of the spring can be made constant or variable along its length and its width.
- The spring can have sections with a C-shaped cross section for a partial envelopment of the foot.
- The frontal part of the spring can be bent, for example, in a hook-like shape, for engaging with protruding uneven irregularities of the support surface.

Thus, the claimed footwear operates based on the use of a user's body weight and energy resulted from the work of the user's muscles for a compulsory change of the angle between the arms of the spring (i.e. loading the spring), and the subsequent return of the spring's energy, when the spring is released (i.e. unloading the spring), which returned energy is utilized for the next repulsing movement of the user's foot forward and upward. In the first version, the arms are represented by the footwear's sole and back element. In the second version, the spring's arms are represented by the frontal portion of the sole and the rear portion of the sole, wherein the frontal portion is cantileveredly secured to the rear portion.

Depending on specific requirements, the initial angle between the arms of the spring may vary.

With the usage of footwear of the first version of execution by 'conservative' and not very physically strong people, it is expedient to use a rather small initial angle between the spring arms (the back element and the sole). For young and trained people, the angle can preferably be wider.

Teenagers might like more extreme versions with the angle closer to 180°. For training sportsmen and for extreme movements, the initial angle can be greater than 180°.

In that case, at the moment of putting the footwear on a foot (before the foot in the footwear is placed on the support surface), an initial (preliminary) compulsory deformation (compression) of the spring is effected by means of applying the user's muscles efforts thereupon, and after the preliminary compression, the angle between the arms should be no wider than 180°.

In a similar manner, with the use of footwear of the second version, in case of a 'conservative' user, the initial angle between the arms slightly differs from the usual 180° angle. For people, who look for exercising extreme actions (e.g. thrill-seekers), the initial angle may considerably differ from the common 'anatomic' location of the sole's parts.

The magnitude of the initial angle depends also on the spring's characteristics: its elasticity and rigidity, that is determined by the material of the sole and the back element, by the spring's geometrical shape, etc. The more rigid the spring is, the smaller angle is needed to ensure a necessary effect.

In case of a person's body having a significant weight and strong muscles, the movement with a maximal spring deformation is possible at the moment of complete resting on the foot. In case a person is light-weighted or having weak muscles, the movement can be performed with a partial spring deformation and a partial resting on the foot.

The appearance of the claimed footwear is unusual. For instance, in the first version of footwear, the back element is not initially perpendicular to the sole, the angle between them is variable and in a starting position it can be substantially more than 90°. In the second version of footwear, the sole's front portion is bent out downwards.

An additional condition is the need for reliable leg fixing in the footwear. The fixing can be ensured with the boot's upper made higher than usual, and can be ensured with the use of special fixing elements, for example straps in the zone of shank and foot.

Patent research has shown that the claimed footwear corresponds to the criteria "novelty" and "level of invention". The footwear can be produced industrially or domestically, hence it meets the criterion of "industrial applicability".

BRIEF DESCRIPTION OF DRAWINGS

The essence of the invention is exemplarily illustrated in drawings appended hereto, wherein FIGS. 7-11 depict footwear of the second version, according to preferred embodiments of the present invention.

FIG. 1 shows the appearance of inventive footwear of the first version put on a person's leg at the moment of a first contact with the support surface with an initial angle between the spring's arms slightly greater than 90°.

FIG. 2 shows the same position of the leg in the footwear but with an initial angle between the spring's arms substantially more than 90°.

FIG. 3 shows a position of the leg in the footwear with the maximally deformed spring (the angle between the arms is less than or equal to 90°) and variants of the rear view.

FIG. 4 shows a type of the inventive footwear with partial envelopment of the lower part of shank and a part of foot by the spring.

FIG. 5 shows the appearance of the inventive footwear (without a leg) at a 180° angle.

FIG. 6 shows the appearance of the inventive footwear (without a leg) at an angle greater than 180°.

FIG. 7 shows the appearance of the footwear of the second version with a compound sole and an initial angle between the spring's arms of little less than 180°.

FIG. 8 shows the inventive footwear with an initial angle substantially smaller than 180°.

FIG. 9 shows the inventive footwear with an angle between the spring's arms smaller than 90°.

FIG. 10 shows the inventive footwear with a hook-like bent spring.

FIG. 11 shows variants of deformation in walking with a compound sole presented on FIG. 7, depending on the physical properties (elasticity, rigidity) of the spring (the dotted line shows an initial free position of the spring) and the load intensity, wherein:

Figure 1:
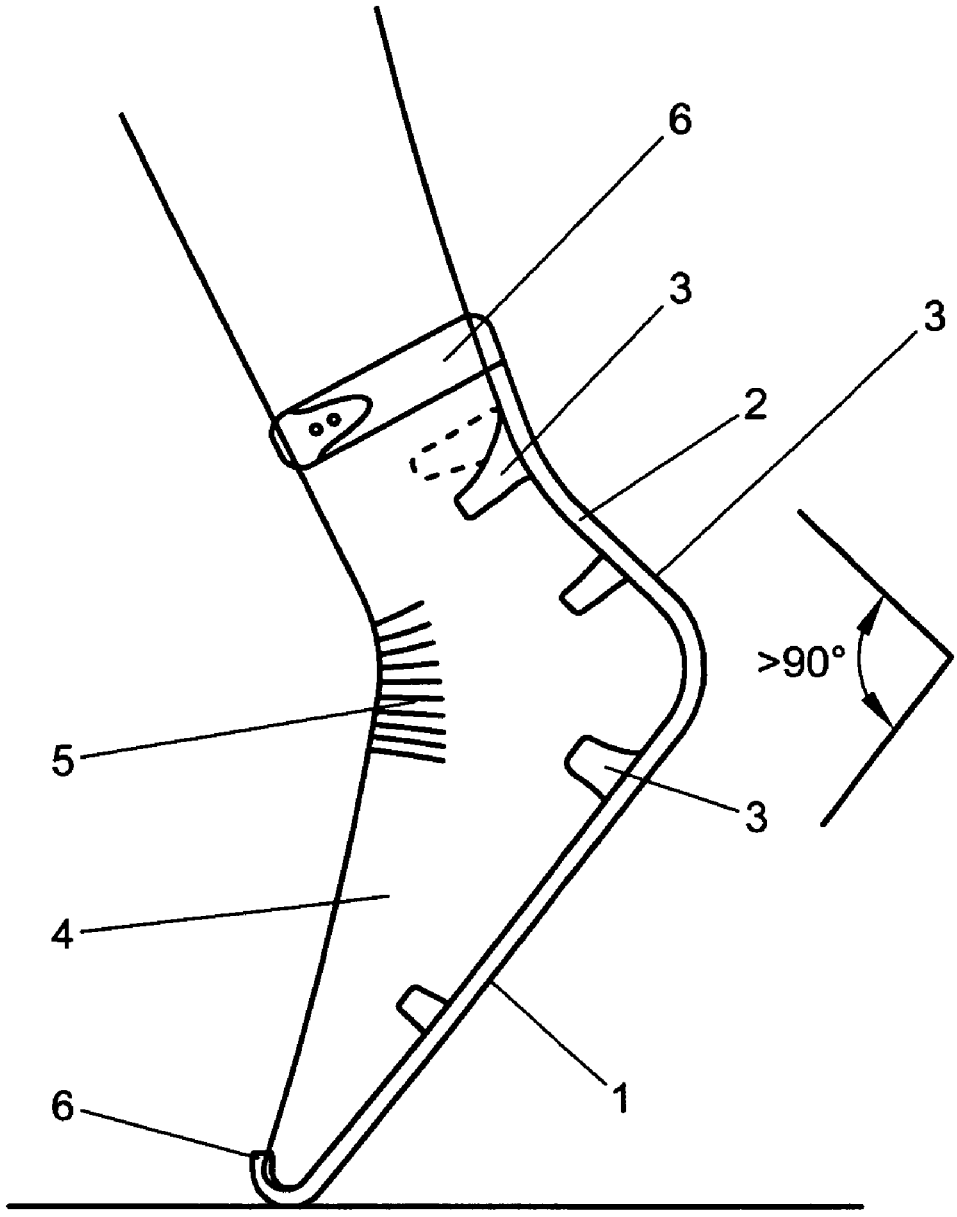
FIGS. 1-6 depict footwear of the first version.
Figure 2:
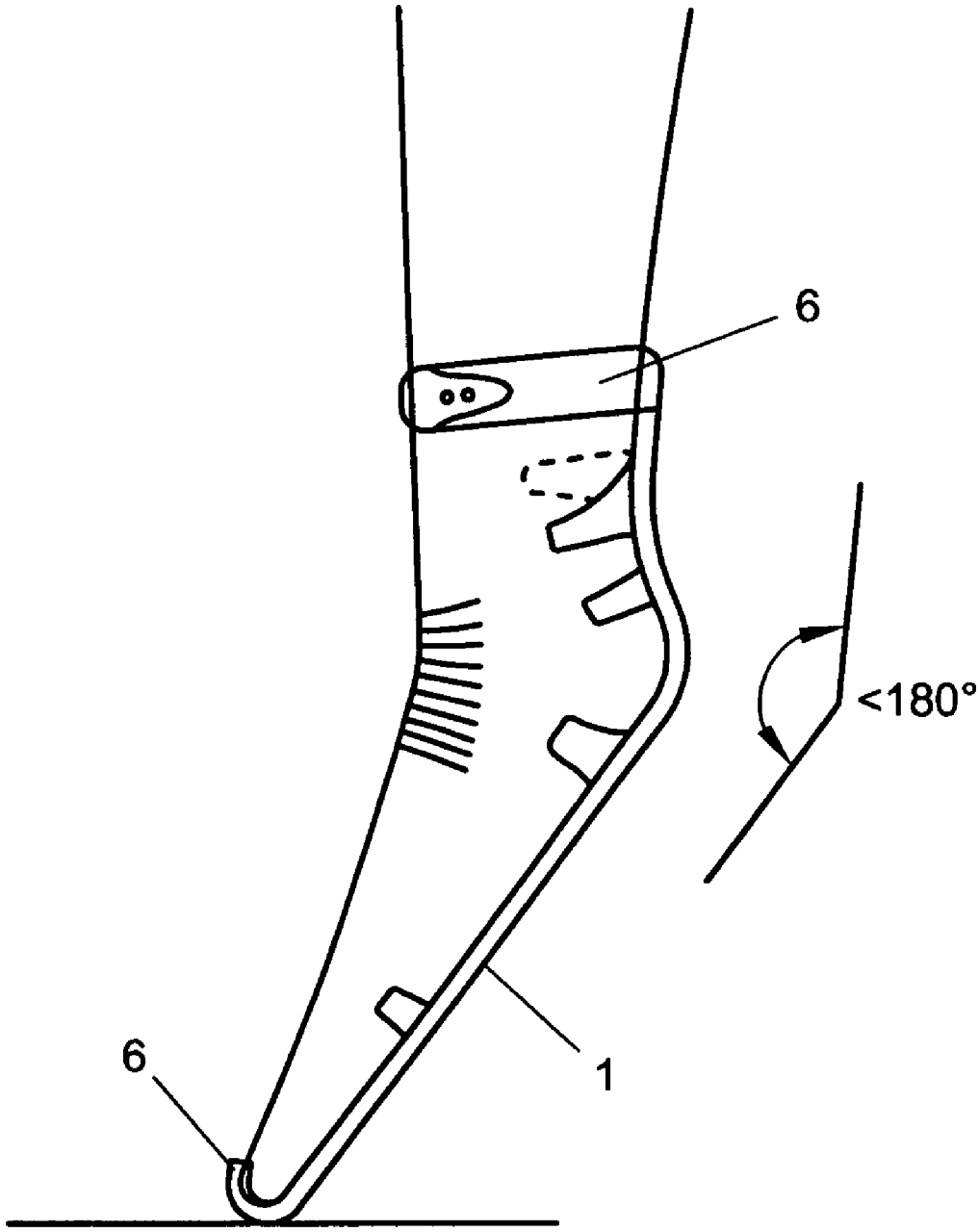

While the invention may be susceptible to embodiment in different forms, there are shown in the drawings, and will be described in detail herein, specific embodiments of the present invention, with the understanding that the present disclosure is to be considered an exemplification of the principles of the invention, and is not intended to limit the invention to that as illustrated and described herein.

DESCRIPTION OF DESIGN AND USE OF FOOTWEAR OF THE FIRST VERSION

Referring to FIGS. 1-6, a preferred embodiment of the first version of inventive footwear comprises a sole (1), a back element (2) (or simply a back 2), the sole 1 and the back 2 form a deformable leaf spring (3) with a predetermined elasticity; and a footwear upper (4) connected with the sole 1 and back 2.

In one preferred embodiment of the first version, the sole 1 and the back 2 are being arms of the leaf spring 3, i.e. the sole and the back form the spring themselves. In the other words, the spring 3 is composed of the sole 1 and the back 1. In this case, the sole 1 and the back 2 can be manufactured of materials elastic enough (e.g. elastic polymeric materials) to ensure the required conditions.

The back 2 is one of elements fixing a position of the foot relative to the sole 1. In the footwear without a user's leg inserted therein, an initial angle between the sole 1 and the back 2 is always more than 90°, and the initial angle can be even greater than 180° (e.g. see FIG. 6). The footwear design ensures a reduction of the angle between the sole 1 and the back 2 in interaction of the footwear with the leg.

In another preferred embodiment of the first version, the sole 1 and the back 2 can be manufactured of usual materials typically employed for making footwear, whereas the arms of the leaf spring 3 are manufactured of any elastic materials (preferably, including a proper type of metal) and exhibiting spring properties. The sole 1 and the back 2 can then be rigidly connected to the corresponding arms of spring 3. In such case, the sole 1 and the back 2 together with the spring 3 rigidly connected thereto also constitute a flat spring unit.

Depending on its purpose the claimed footwear can be embodied in various forms. It can be warm winter footwear such as boots or high boots, or it can be light-weighted footwear for summer, for example, sandals or jogging shoes (not shown on the drawings).

The upper 4 can have a usual form for closed footwear, however it should provide for changing the angle between the sole 1 and back 2 within a predeterminedly wide range. For this purpose it can be manufactured of an elastic material or can contain easily deformable inserts (5), for example corrugated in the zones subject to stretching and compression.

The footwear upper 4 can constitute or include other fixation elements (6) ensuring a reliable fixing of the leg in the footwear. The additional fixing elements 6 can be made in the form of a belt, string, elastic tape etc. covering a shank, ankle joint, or foot (see FIGS. 1, 2, and 3). An element preventing the leg displacement out of the sole's limits can also be referred to as one of the fixing elements 6. It can be a rigid boot toe or a superimposed plate bent upwards on the sole 1 (see FIGS. 1 and 2).

An initial angle between the spring arms (a sole 1 and a back 2) is more than 90°. The widest possible angle can be up to 220° and even more (see FIG. 6).

The footwear with the angle of more than 180° is expedient for using in sports or for training, since in this case, prior to the beginning of movement, while putting on the shoes, it is necessary to apply certain muscle effort for an initial preliminary spring compression to exclude a reversed angle, as otherwise the leg would not fit into the footwear. The same effort is necessary for any separation of the leg from the support surface. Use of the footwear with the angle greater than 180° is associated with some risk and thusly requires special skills.

The spring's rigidity can be constant along the length and the width of the spring, or can be variable. For example; the material of spring can have various longitudinal rigidity characteristics.

The spring 3 composed of the sole 1 and the back 2 can have the same cross-section along the whole length.

In other embodiments, the size and shape of the cross-section along the spring can vary longitudinally. For example, for increasing the spring's rigidity in certain zones, the cross-section area can be increased.

The spring can be manufactured with a partial envelopment of the leg. In this case, the spring can have a C-shaped cross-section in some zones (see FIG. 4).

As illustrated on FIG. 1, the spring 3 is furnished with C-shaped outstanding elements (e.g. braces) with a limited width, also denoted by the reference number 3. They embrace the leg in the foot zone and in the back part.

Figure 4:
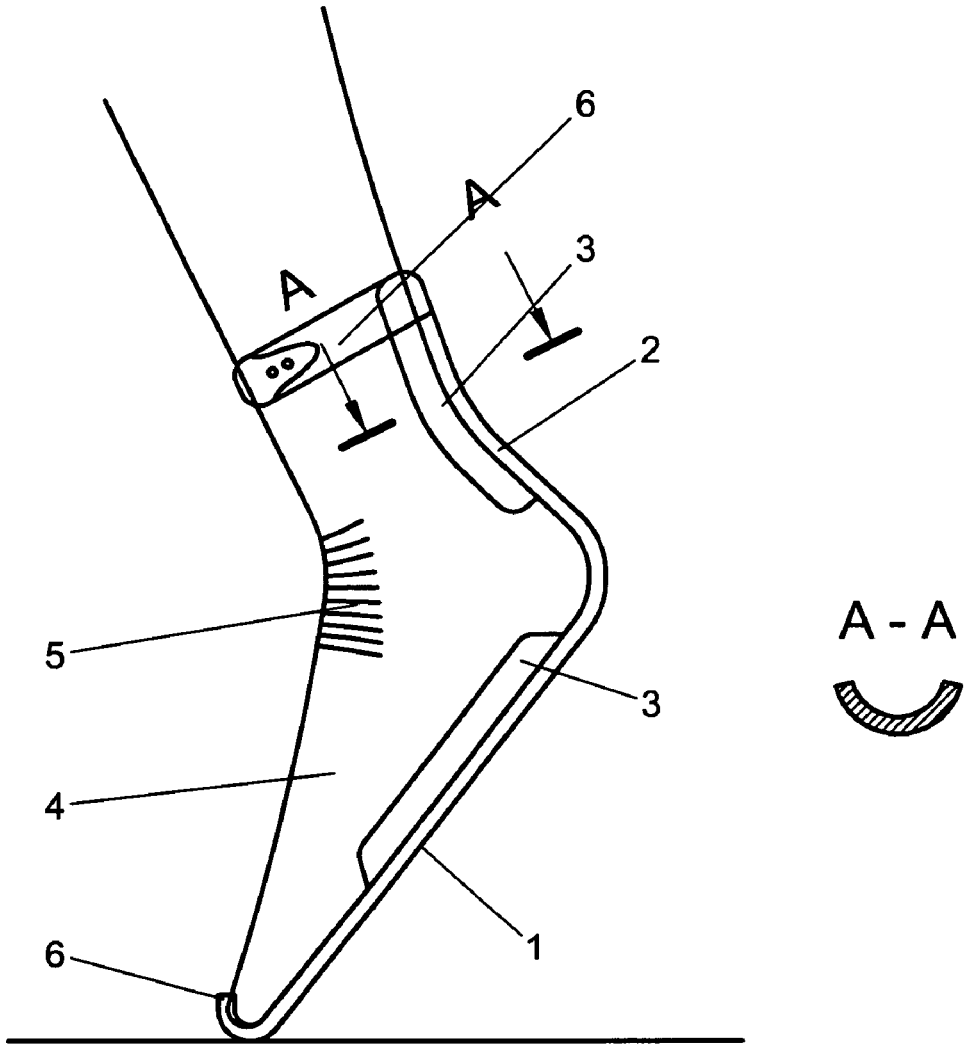

FIG. 4 (section A-A) shows these C-shaped outstanding elements of the spring 3 made elongated that provides for embracing the leg with significant surface coverage.

Other versions of execution of the spring are also possible.

The amount of the spring's rigidity of can be chosen depending on its purpose: a "soft" spring 3 can be deployed for the footwear of everyday use, and a more rigid spring 3 may be utilized for the sports footwear.

It is expedient to provide an opportunity of a foot's flexing. It can be done by employing the spring, composed of the sole and the back, with two zones of bending: a first zone is located in the heel part of footwear, and a second zone is located in the region of the leg's toe-ends (not shown on the drawings).

Figure 5:
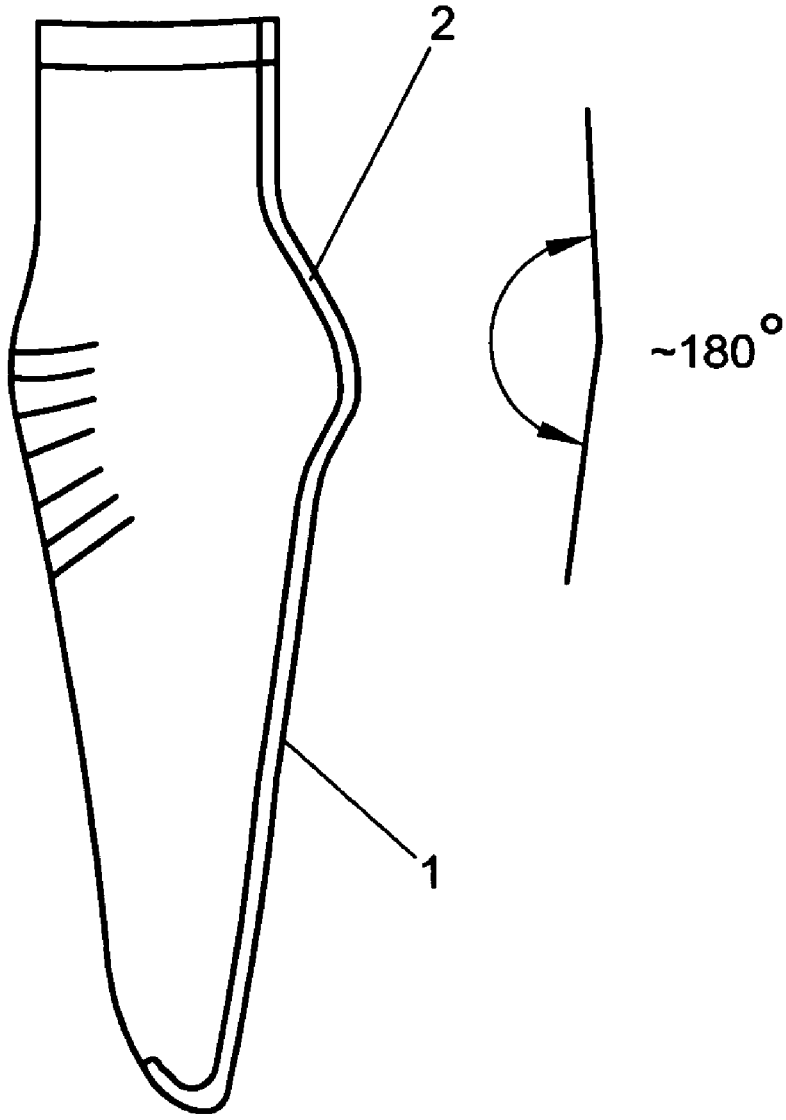
Figure 6:
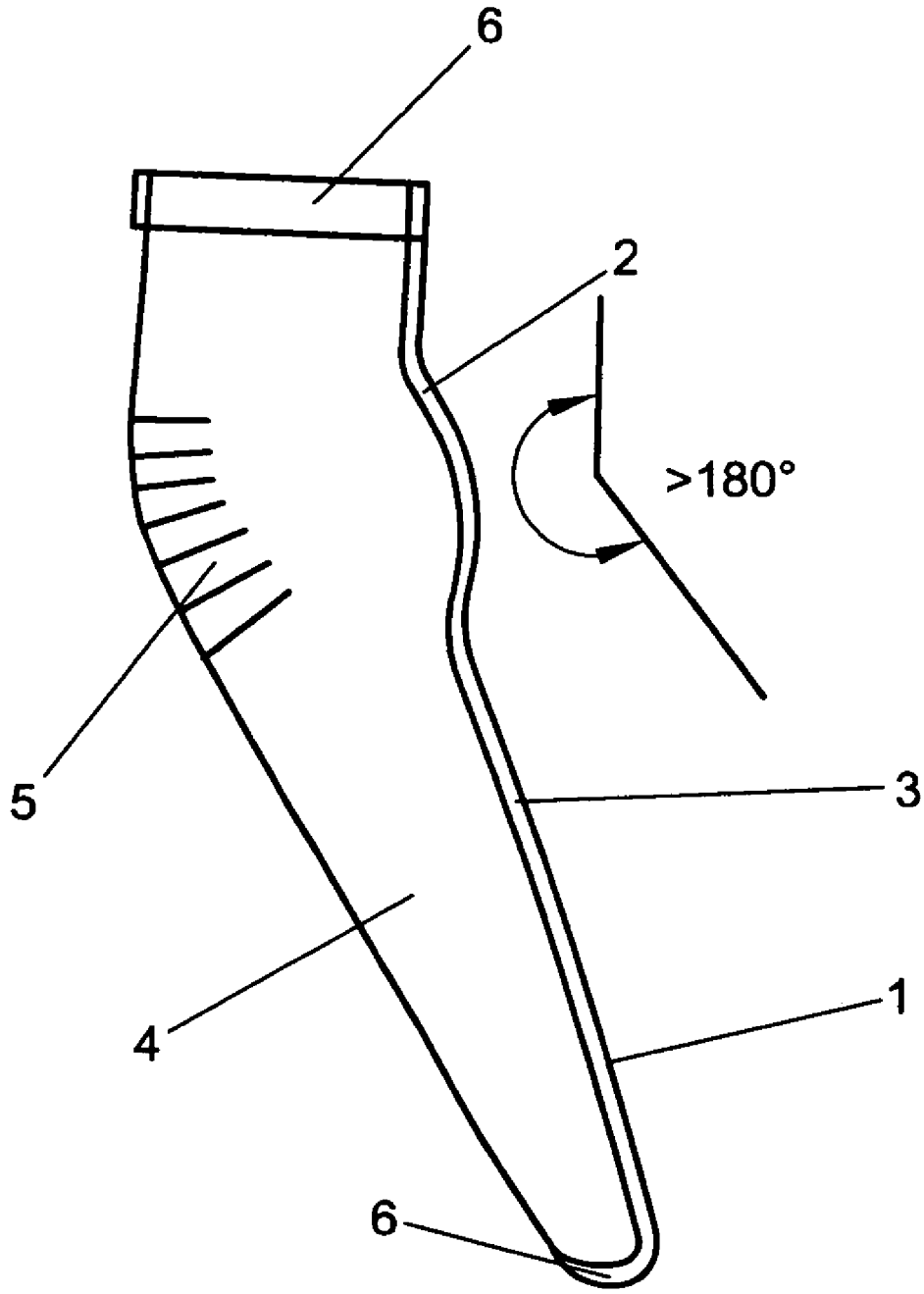

When using significantly rigid springs, it is necessary to provide a bend under the heel as shown on FIGS. 5 and 6.

The form of footwear also determines the character of walking or running in it. At the moment of separation from the support surface, the angle between the sole 1 and the back 2 is increased because of a release of the spring. The direction of the foot approaches to the direction of the leg's shank. Therefore the leg lands on the forefoot and only then the foot lowers until the sole comes into a full or partial contact with the support surface.

At the full contact, the angle between the sole and the back approaches to the traditional 90° angle. This allows using a person's physical abilities more effectively, in particular, to use completely his/her weight and to ensure effective work of the ankle joint and the Achilles tendon.

A preferable way of movement in the footwear of the first version follows. A person chooses footwear with the most suitable spring characteristics (the angle between the sole 1 and the back 2, and the rigidity of the spring) and puts the footwear on. In a free state, the foot is not supported on the ground, and oriented in a direction, which is close to a shank's direction.

For the footwear with a 180° angle, the direction of the foot in the free state coincides with the shank's direction. For the footwear with an angle of more than 180°, the direction of the foot coincides with the shank's direction, due to the fact that the user's overcomes the spring's pressure by effort of muscles at the moment of putting the footwear on, making the angle closer to 180°, his/her muscles are constantly tensed to maintain the angle between spring's arms in the limits allowed by physiological properties of the foot.

Figure 3:
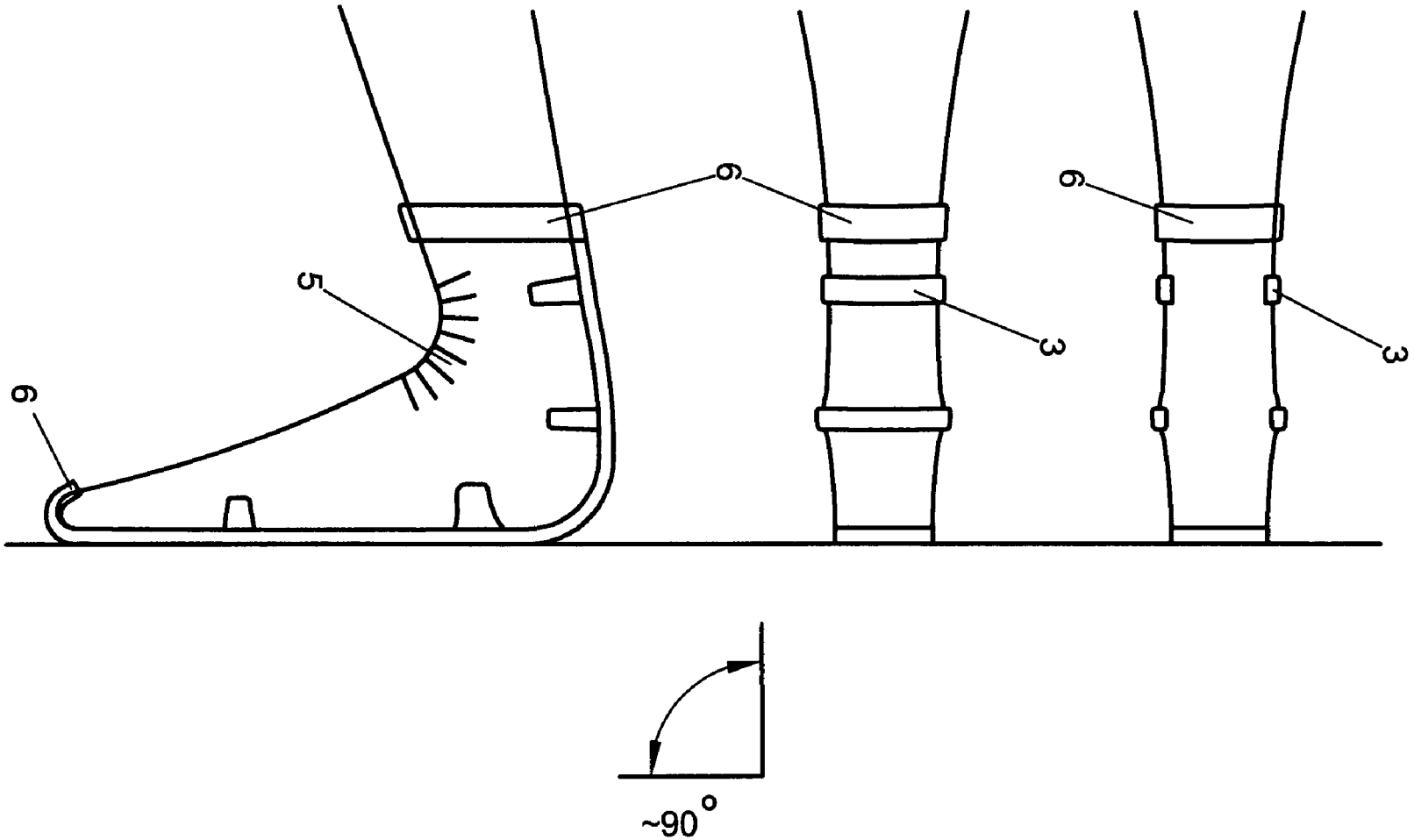

Then the person steps down on the support surface. The "sole-back" spring of the footwear is deformed with the angle between arms approaching to 90°. Then the person begins moving, raising one leg and continuing to rest on the other one. At raising the leg, the spring is released with increasing of the angle between the spring's arms up to the initial one, simultaneously pushing away the leg forward and upwards. Then the person lowers the leg on the support surface. At this point, the spring 3 is maximally unbent, the foot touches the support surface not with the heel portion, but with the forefoot portion, and thereafter the leg, overcoming the spring's reaction, deforms (compresses) the spring up to an angle approaching 90° (FIG. 3).

A heavy-weight person, while walking, rests on the whole foot's surface. If a person's weight is comparatively small, his/her pressure will not suffice for the complete spring compression, and he/she will move resting only on a portion of the foot, for example, "on tiptoe".

There is another possible way of moving in the inventive footwear, primarily intended for training of muscles. The leg, which is not touching the support surface, is permanently strained to a certain extent. The user with his/her muscles effort compresses the spring, trying to keep the angle between the back and the sole of approximately 90°. In this case the footwear accumulates primarily muscle energy. The user can weaken the leg muscles only at the moment when that leg rests (stands on the support surface). At this time, the action of muscles is replaced with gravitational forces determined by the weight of the user's body. The landing of the leg in such way of moving can happen in various manners: on the toe, on the whole foot, on the heel depending on the character of movement and the user's desire.

It is also possible to provide deformation of the spring caused by a calf muscle's work. In that case, for ensuring the spring compression, it is necessary to ensure contact of the footwear back with this muscle, for example by way of making the footwear upper high enough, even partially covering the leg's shank, or by way of using special fixing belts. In such an embodiment, the spring deformation (the reduction of the angle between the back and sole) will be provided by turning the leg on the ankle joint.

DESCRIPTION OF DESIGN AND USE OF FOOTWEAR OF THE SECOND VERSION

Referring to FIGS. 7-11, the claimed footwear of the second version includes a sole 1 and a spring 3. Distinctly from the first version, the spring 3 is a frontal component of the sole 1. The spring 3 is cantileveredly fixed with a console to a second rear portion 2 of the sole 1. Thus, the console spring 3 is an extension of the rear (main) part 2 of the sole 1. In its initial position, the spring 3 is bent downwards at an a angle in relation to the rear part 2.

A bend zone can be defined in the region of joining the frontal component (spring) 3 with the rear portion 2. The bend zone of the sole 1 can be arranged corresponding to the traditional places of foot bending: the end of the toe portion of the foot, the ending zone of metatarsus (cannon), or the zone contiguous to the heel.

The footwear upper 4 has a function of fixation of the foot's position against the sole 1, and can be performed partially or completely of an elastic material allowing, on the one hand, a periodic bending or folding of the sole 1, and, on the other hand, depressing the foot, including its frontal portion, against the spring-sole 1. If desired, the user can prevent the bending of the spring by effort of muscles (returning the spring to the initial position), or can forcibly straighten it.

Figure 7:
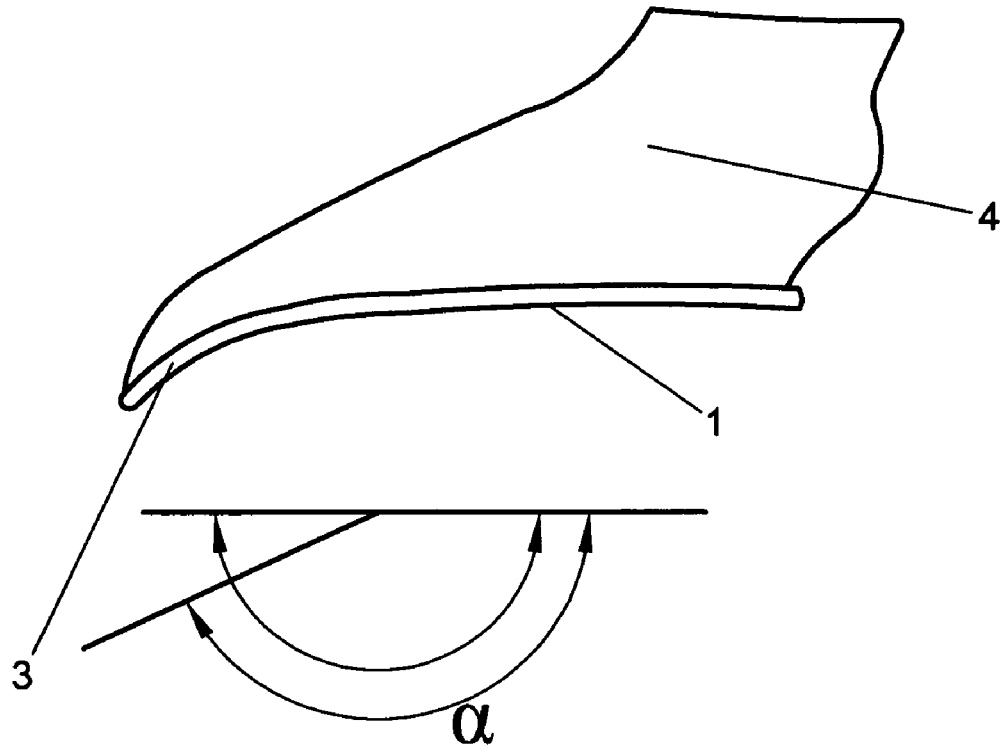
Figure 8:
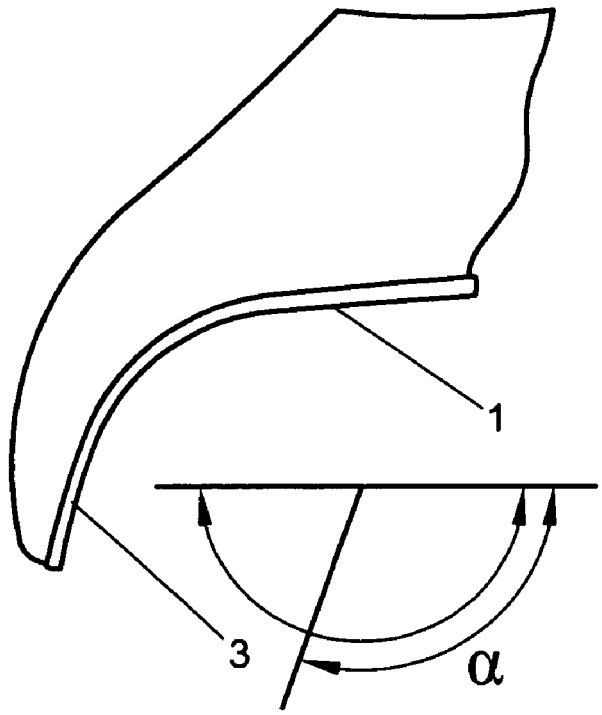
Figure 9:
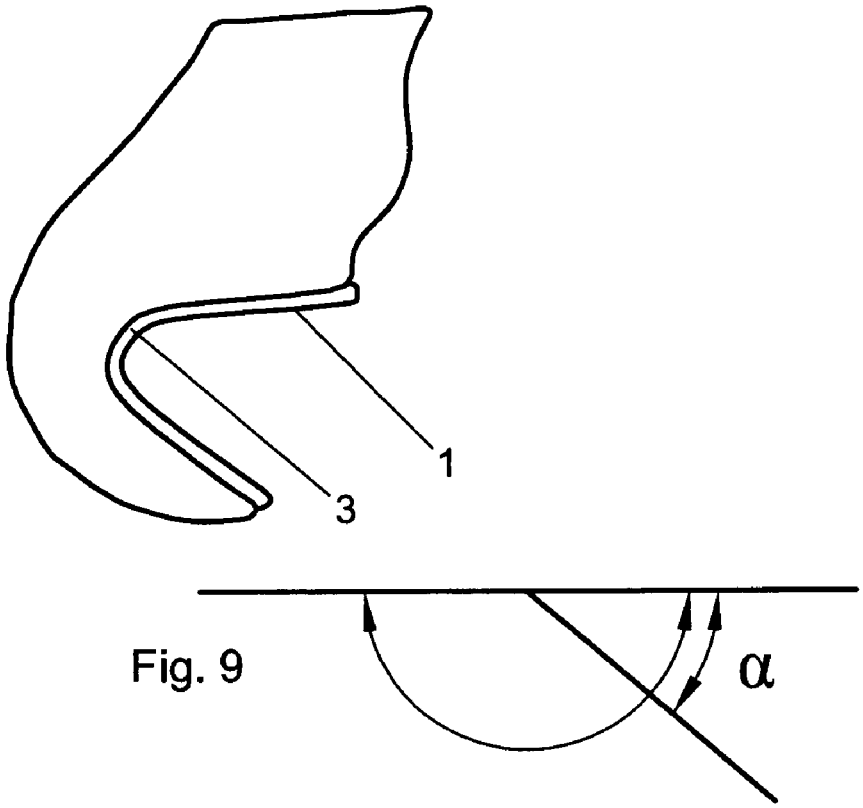
Figure 10:
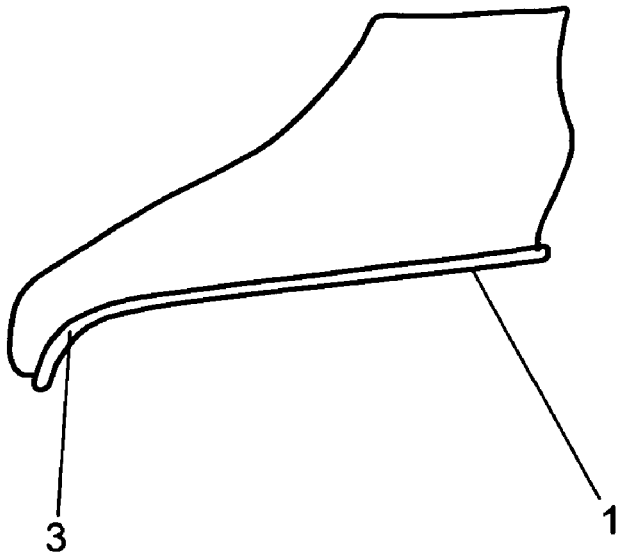
Figure 11A:
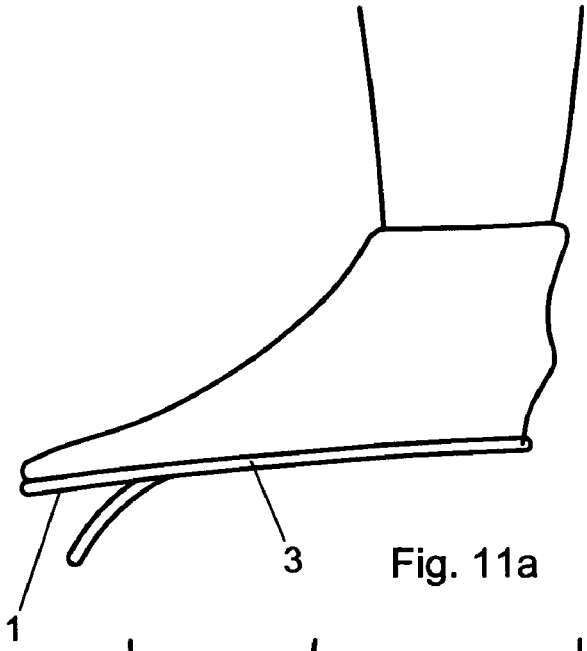
FIG. 11*a* shows the spring that is loaded and straightened (the spring and the remaining part of sole are located in one plane)
Figure 11B:
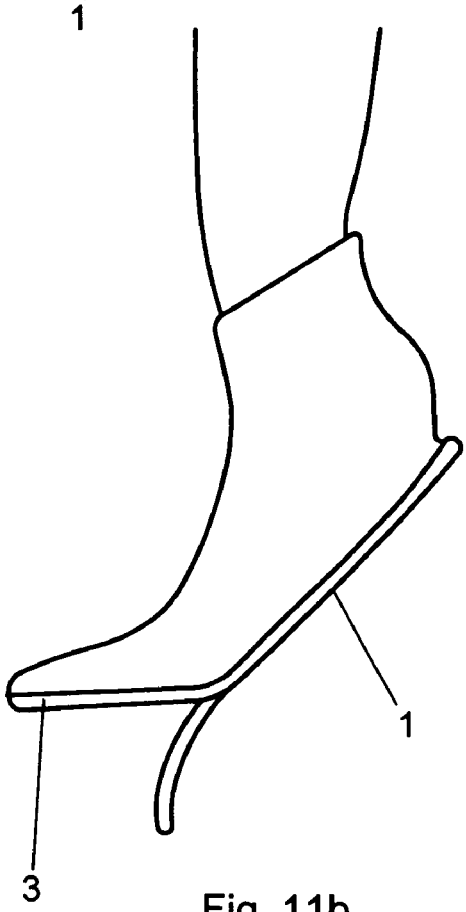
FIG. 11*b* shows the spring that is loaded and bent in the direction opposite to an initial position.
Figure 11C:
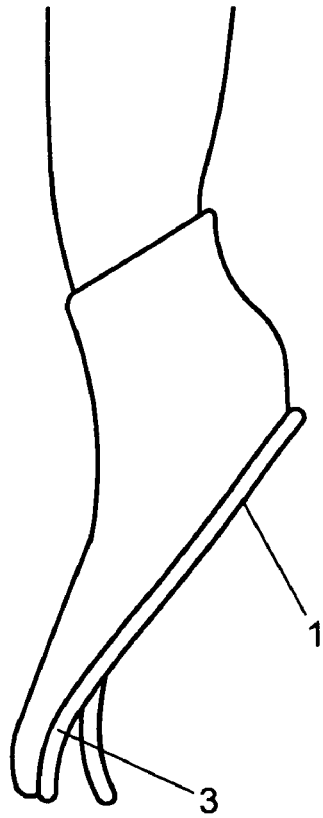
FIG. 11*c* shows the rigid spring that is under-loaded with an insufficient action of a body's weight, or insufficient muscles effort; the spring does not reach a flat condition, and remains bent downwards though at an angle greater than the initial angle between the spring and the sole's rear part.

According to the invention, without the user's foot placed in the footwear, the initial angle α between the elastic frontal part of the sole 1 and the rear part of the sole 1 is less than 180° (FIGS. 7, 8, 9). The angle magnitude may be various; in particular it may be less than 90° (FIG. 9).

The spring 3 of the sole may be made of elastic polymers and its characteristics may be either longitudinally constant or variable.

In other embodiments, the size and form of the cross-section along the spring's length may be different. For example, to increase the spring's rigidity, the cross-sectional area in certain zones could be increased.

The spring may also be made with a partial embracing of the foot. In this case, certain zones of the spring may have a C-shaped cross-section.

The rate of the spring rigidity may be chosen depending on its purpose: a "soft" spring can be used for everyday footwear, whereas a more rigid spring can be usable for the sport footwear.

The upper 4 of the footwear may be made of or include fixation elements that provide for securing the foot, including its forefoot and metatarsus parts in the footwear. The fixation elements may be performed in the form of:

- toe part of the upper 4, rigidly connected with the spring 3 (being the frontal part of the sole) and forming a cavity for placing the toes of foot;
- foot-embracing small straps, bands, and similar rigid or elastic fixing elements; wherein these or other fixing elements also prevent movement of the foot along the sole or its parts.

It is reasonable to use the footwear with the angle near or less than 90° during sport trainings and events, since one has to apply a certain muscular force right at the moment of putting the shoes on the feet prior to the beginning of movement for initial pre-stretching (unbending) of the spring 3 to exclude a considerable over-bending of the foot toes. Forces like these are necessary by any separation of the foot from the support surface. The use of the footwear with an angle magnitude near 90° (FIG. 9), involves certain risks and thus requires special practice.

Decorative appearance of the second version footwear is also uncommon. The sole is not straight, but has a clearly defined over-bending; the angle between the console spring and the main rear portion of the sole is less than the traditional 180° angle; the frontal portion of the sole in its initial state is bent down.

Making part of the sole in the form of a console fixation element bent down in the initial position provides for periodical deformation of the sole under the weight of the user and/or forces of muscles and tendons of the foot, with simultaneous accumulation of energy spent for this deformation. When the body weight is transferred from one foot to the other, the spring of the sole of the first foot, being free from the body weight, tends to return to its initial bent down position. Returning of the spring to this position could be done either gradually or rather quickly. In the process of return, the spring repulses the foot toes from the support surface to move the foot forward. The process of movement in the inventive footwear resembles a tiptoe walk: at every step the user is pushed away from the support surface, this pushing away is completed automatically.

During an ordinary walk, deformation of the spring is mainly provided by the user's weight. When the foot is separated from the support surface and the foot muscles are relaxed (the foot doesn't tend to support the flat position of the spring), the angle between the frontal and rear parts of the sole returns to its initial position due to the spring release.

As a result of bending the spring, touchdown is done on the forefoot, projecting down, and only then, under the action of human weight, the sole straightens and the foot touches the ground fully or partially. At the full contact, the angle between the frontal toe sole portion and the rear main portion of the sole nears to the traditional 180° angle.

Another manner of movement is possible as well: the touchdown may begin with the heel of the foot with a simultaneous spring deformation under the human weight until the spring becomes flat.

It is also possible to move as follows: the user, using his/her foot muscular forces, prevents bending of the spring in the moments when the foot is not supported against the surface. In this case, the sole in the movement process stays nearly straight and the touchdown may be of any kind, with respect to the user's wish.

Depending on a human's weight and muscular force, he/she can move with a maximal spring deformation till the foot is fully supported against the ground (the angle between the spring and the rest part of the sole is nearly equal to 180°), or with a partial spring deformation (the angle between the sole parts is less than 180°), whereat the individual walks on tiptoes, the rear part of the foot does not touch the support surface.

The initial angle of the spring's bend may be different. For example, if the inventive footwear is used by conservative and not muscularly fit people, it is reasonable to use a relatively small deviation from the traditionally flat sole, to use the footwear with the initial angle of the range 165°-175°. For young and trained people the initial angle between the spring and the rear part of the sole may be 140°. More 'extreme' users may wish to try the footwear with angles nearing to 120°. For sports people training as well as for extreme movements, the initial angle may reach 90° or even may be less.

It should be noted that the effect derived from energy accumulated by the inventive footwear is determined not only by the rate of initial deviation of the frontal portion of the spring sole. Just like in the first version footwear, the effect is substantially determined by the spring's characteristics: its elasticity and rigidity that is by the material, which the footwear sole is made of, the configuration of the spring, and so on. The more rigid the spring is, the lesser is the difference of the initial angle from the traditional angles, required to reach the needed effect of the footwear.

Rigidity and an elasticity coefficient can vary along the spring's length; for example, at the zone of over-bend the spring may be less rigid than in the remaining part thereof.

Besides, it should be noted that making movements in the inventive footwear is easier, since not only the elastic properties of the sole are used. For example, the rear portion of the sole, situated under the heel, during the repulsion of the spring from the support surface, operates as a lever relative to the junction point of the spring and the rear portion of the sole. In this case the action of the released energy, accumulated by the spring, is complemented by the action of this lever. The spring, turning relative to the point of console fixation, acts upon the rear portion of the sole, tending to turn it upwards.

Essential are also characteristics of the fixation elements that secure the position of the foot relative to the sole. These elements are to depress the foot of the leg against the sole in any position of the foot, including the position where the spring is initially bent. Besides, the elements have to provide for partial or full sole strengthening (increasing the angle between the spring of the sole and the rear portion thereof up to 180°) due to the muscular effect of the user. An additional condition is the possibility to change the angle without destruction of the footwear parts.

Making the frontal portion of the sole in the form of a bent-down hook allows using the footwear for movement on stones and rocks, e.g. during a hiking. In such a case, if needed, the user can catch himself on an unevenness of the ground, and find an appropriate support for the second foot. The spring depresses the frontal portion of the sole with the hook-shaped end together with the foot's tip to the selected uneven support. Then the user "straightens" the spring by tension of his muscles, and detaches the foot from the uneven support, transferring his weight to the other foot.

Such footwear allows to effectively use physical resources of a person, particularly to fully use his weight, and provides for effective action of the foot muscles and tendons.

It is recommended that the user first select the footwear with the most appropriate characteristics of the spring 3 and fixing elements. To put the inventive shoes on his feet, the user must either let his feet bend down following the sole 1 under the action of the fixation elements, or, right in the process of putting the footwear on his foot, straighten the spring partially or fully tensing his muscles, that would increase the angle between the spring 3 and the remaining portion of the sole 1 to the possible maximum of 180°.

The user further gets up on the support surface, whereat the weight of the person's body acts upon the spring. Under this action, the spring 3 is deformed and the angle between parts of the sole 1 reaches nearly 180°.

Then the user starts moving. He raises one foot, while supported by the other. At the moment of raising the foot, the spring is released from the action of the user's weight. If the user does not apply a certain muscular strength, the angle between the spring 3 and the sole 1 is decreased to its initial amount, with a simultaneously repulsion of the foot upward and forward. The foot is bent down partially or fully, following the bent down sole. This foot is further put down onto the support surface. The foot may touch the support surface with its tip, and only then, overcoming the action of the spring, the foot deforms the spring to the 180° angle, and at this point the leg is fully supported by the foot.

A trained and heavy-weighted person by his walk even with the rather rigid spring fully supports against the foot surface. A weak and light-weighted person he may lack forces to fully deform the spring, so he would move, supporting only against the part of the foot as by tiptoe walk.

It should be noted that the effectiveness of usage of energy accumulated by the footwear will sharply decrease, if, at the lowering of the foot, the user touches the support surface by the heel. In this case the front part of the foot, bent down following the spring, remains being bent. The leg is supported only against the heel.

If however the user moves by firstly raising the heel and being supported by the tip, further repulsing the tip from the support surface (tiptoe walk), then the spring acts upon the tip of foot most effectively.

The described preferred embodiments of the footwear are simple to produce and easy to use. They allow for effective utilization of the user's weight as well as his muscular work for accumulation of energy and its transfer for repulsion of the feet at the next step. The inventive footwear may be used both in everyday life by different categories of users, and for physical exercising or sport training. It may also be used for rehabilitation purposes, such as development of joints after injuries etc.

In addition to the increase of the movement effectiveness due to using the released energy by freeing the spring, the inventive footwear might be interested to jumpers. They can prepare their bodies to jump and perform the jump in an optimal moment, which drastically enhances its effectiveness. For this purpose, the user makes a preliminary swaying: partial compression and releasing of the spring using muscular efforts, for example, by bending and unbending of the feet, gradually increasing the amplitude and frequency of oscillations. When the spring is compressed to its maximum, he jumps. In the process it is possible to use the effect of resonance.

The same work can be done when a sportsman (especially a sprinter) is preparing to run. The swaying can provide more powerful spurt at the start.

Wearing the inventive footwear, one can sit, stand, walk with a slow o rapid pace, run, and jump. Besides, special footwear for skies, skates, etc. can be produced based on the inventive footwear.

Appropriate tests have been carried out. The test have confirmed that upon a correct selection of the initial spring angle and providing with the possibility of deformation of the upper 4, the inventive footwear is comfortable for any category of users and the speed of users' movement greatly increases. In the process, efforts spent by the user for movement with the spring deformation practically do not differ from those spent for the user's movement in ordinary footwear.

I claim:

1. Footwear with accumulation of spring energy, caused by elastic deformation, comprising:

a footwear system, comprising:

an elastic substantially planar sole portion;

an elastic back portion;

an intermediate heel portion between said sole and back portions, wherein said sole portion, heel portion and back portion are integrally formed together; and fixation means for securing the position of a user's foot on said sole portion, wherein said fixation means are coupled with said sole portion and with said back portion;

wherein said sole and back portions, when not contacted by the user, are independently biased at an initial angle exceeding 90° therebetween so as to form a leaf spring of a predetermined bias selectively operable to provide said elastic deformation, wherein said sole and back portions are arms of said leaf spring;

wherein said sole and back portions, when contacted by the user, are selectively operable to be biased by the user of said footwear system to a subsequent angle equal to 90° or less so as to accumulate an amount of spring energy therein.

2. Footwear according to claim 1, wherein said sole and back portions are comprised of elastic polymers.

3. Footwear according to claim 1, wherein said spring includes at least one member with a C-shaped cross-section for partially embracing the user's leg.

4. Footwear with accumulation of spring energy, caused by elastic deformation, comprising:

a footwear system, comprising:

an elastic substantially planar sole portion;

an elastic back portion;

an intermediate heel portion between said sole and back portions, wherein said sole portion, heel portion and back portion are integrally formed together;

fixation means for securing the position of a user's foot on said sole portion, wherein said fixation means are coupled with said sole and back portions; and a leaf spring of a predetermined bias selectively operable to provide said elastic deformation, said leaf spring including two arms respectively coupled with said sole and back portions;

wherein said sole and back portions are biased at an initial angle exceeding 90° therebetween;

wherein said sole and back portions are selectively operable to be biased by a wearer of said footwear system to a subsequent angle equal to 90° or less so as to accumulate an amount of spring energy therein.

5. Footwear according to claim 4, wherein said leaf spring is comprised of elastic polymers.

6. Footwear with accumulation of spring energy, caused by elastic deformation, comprising:

a sole member including a frontal portion and a rear portion, wherein at least a portion of said frontal portion of said sole member comprises a spring of a predetermined bias selectively operable to provide said elastic deformation, wherein said frontal portion extends downwardly towards a bottom surface of said rear portion of said sole member; and fixation means for securing the position of a user's foot on said sole member, wherein said fixation means are coupled with said sole member and depress the front part of the user's foot against said spring;

wherein said frontal and rear portions of said sole member are biased at an initial angle therebetween.

7. Footwear according to claim 6, wherein said initial angle is less than 180°.

8. Footwear according to claim 6, wherein a bend zone is defined in the region of joining said frontal portion of said sole member with said rear portion of said sole member; and said bend zone is located substantially at either the beginning of the metatarsus of the user's foot, at a phalanx of toes of the user's foot, or near the heel of the user's foot.

9. Footwear according to claim 6, wherein said spring is comprised of an elastic polymer.

10. Footwear according to claim 6, wherein said spring is formed as a hook-shaped member.

* * * * *